United States Patent [19]

Brown

[11] Patent Number: 4,872,233

[45] Date of Patent: Oct. 10, 1989

[54] STREET SWEEPER WITH COOL SPRINGS SUPPORTED DRAG SHOE

[75] Inventor: Stanley M. Brown, Wake Forest, N.C.

[73] Assignee: Athey Products Corp., Raleigh, N.C.

[21] Appl. No.: 276,653

[22] Filed: Nov. 28, 1988

[51] Int. Cl.[4] ..... E01H 1/04

[52] U.S. Cl. ..... 15/83; 15/246; 15/257 R

[58] Field of Search ..... 15/246, 257, 82–86, 15/340

[56] References Cited

U.S. PATENT DOCUMENTS 4,450,601 5/1984 Shwayder ..... 15/246

4,557,010 12/1985 Rosseau ..... 15/83

*Primary Examiner*—Edward L. Roberts

*Attorney, Agent, or Firm*—Rhodes, Coats & Bennett

[57] ABSTRACT

The present invention entails a street sweeper having a drag shoe assembly secured to each side of the street sweeper for confining dirt, debris, etc. Each drag shoe assembly includes an upper frame structure and a drag shoe coupled to the upper frame structure via two generally parallel interconnecting coil spring links. In the event the drag shoe encounters a lateral obstruction while the street sweeper is turning or moving laterally in any way, the coil spring interconnecting links will flex and enable the drag shoe to move laterally back and forth to avoid damage to the drag shoe or frame structure of the street sweeper.

8 Claims, 3 Drawing Sheets

STREET SWEEPER WITH COOL SPRINGS SUPPORTED DRAG SHOEcFIELD OF THE INVENTION

The present invention relates to street sweepers and drag shoe assemblies therefore and more particularly to an interconnecting mechanism for connecting the drag shoe to the street sweeper so as to avoid damage to the frame structure of the street sweeper in cases where the drag shoe encounters lateral obstructions.

BACKGROUND OF THE INVENTION

Drag shoes are typically utilized by street sweepers to confine dirt, debris, dust, etc., inwardly of a main street sweeping brush. Typically, a drag shoe assembly is mounted to each side of a street sweeper and depends downwardly therefrom adjacent the main sweeping brush or broom. As the brush rotates, dirt, debris, dust, etc., being moved by the brush tends to be confined underneath the sweeper by the drag shoes.

Since the drag shoes must engage the underlying surface being traversed by the sweeper, it follows that it is desirable for the drag shoe to be mounted such that it can float or move up or down over uneven surfaces. This is typically provided by a series of rigid links interconnected between the street sweeper and the drag shoe.

One of the most common problems encountered with street sweepers and drag shoes, results when the street sweeper is being turned or moved laterally and the drag shoe encounters an obstruction such as a manhole cover, street curb, or the like. Typically there is little flexibility built into the linkage interconnecting the drag shoe with the street sweeper's frame structure. Once the obstruction or lateral load is encountered the drag shoe is forced to move laterally. The result is that the drag shoe is often damaged as well as the upper supporting frame structure and the interconnecting linkage arrangement. Also, the impact is such that the drag shoe will not freely return to its initial normal vertical position. The end result is that the drag shoe assembly has to be repaired or replaced at substantial expense not to mention the time that the street sweeper is kept out of service. In addition, in some situations the damage to the frame structure is so extensive that the actual frame structure of the street sweeper has to be repaired.

In the past, there have been interconnecting linkage systems provided that are designed with built in slop that enables the drag shoe to move to some degree laterally back and forth. For example, one is referred to the disclosure found in U.S. Pat. No. 4,557,010. There the drag shoe is supported by a series of rigid "z" bars that are connected between the frame structure of the street sweeper and drag shoe such that the actual connections incorporate slop to allow the drag shoe to move slightly laterally in response to an obstruction. But the drawback to this design is that the interconnecting links are still very rigid. As a result, the drag shoe can not withstand a substantial impact with a lateral obstruction during a turning maneuver, for example, without resulting in substantial damage to the drag shoe and the frame structure of the street sweeper.

Therefore, there is and continues to be a need for a drag shoe assembly for a street sweeper that will withstand substantial lateral impacts with obstructions such as manhole covers which will not result in significant damage to the drag shoe nor to the frame structure of the street sweeper.

SUMMARY AND OBJECTS OF THE INVENTION

The present invention entails a drag shoe assembly for a street sweeper that addresses the above discussed problems and which does in fact provide a drag shoe assembly that will confine dirt, debris, dust, etc., inwardly thereof but which will also withstand substantial lateral impacts from obstructions without damaging the drag shoe or street sweepers frame structure.

To achieve this, the drag shoe assembly of the present invention provides a pair of parallel disposed coil springs pivotally connected about opposite ends between an upper frame member and the surface engaging drag shoe. The pivotable connection at each end of the coil springs enables the drag shoe to float up and down as the street sweeper moves over uneven surfaces. But also the coil springs are sufficiently strong such that when a lateral impact is encountered by the drag shoe the coil springs will flex enabling the drag shoe to move laterally and then to move back to its initial vertical position once the obstruction or lateral load has been cleared.

It is therefore an object of the present invention to provide a street sweeper drag shoe assembly that will enable the drag shoe to encounter substantial lateral impact from obstruction or lateral loads without damaging the drag shoe or the street sweeper.

Still a further object of the present invention resides in the provision of a drag shoe assembly that is capable of maintaining the drag shoe in a relatively firm and stable normal operating posture but which is still capable of laterally flexing to either side in response to the drag shoe encountering an obstruction while the street sweeper is turning or otherwise moving laterally.

Another object of the present invention resides in the provision of a street sweeper with a drag shoe assembly that comprises a pair of generally parallel disposed coil springs that function as supporting links for the drag shoe and also enable the drag shoe to flex a substantial degree to one side or the other.

Other objects and advantages of the present invention will become apparent and obvious from a study of the following description and the accompanying drawings which are merely illustrative of such invention.

DETAILED DESCRIPTION OF THE INVENTION

Figure 1:
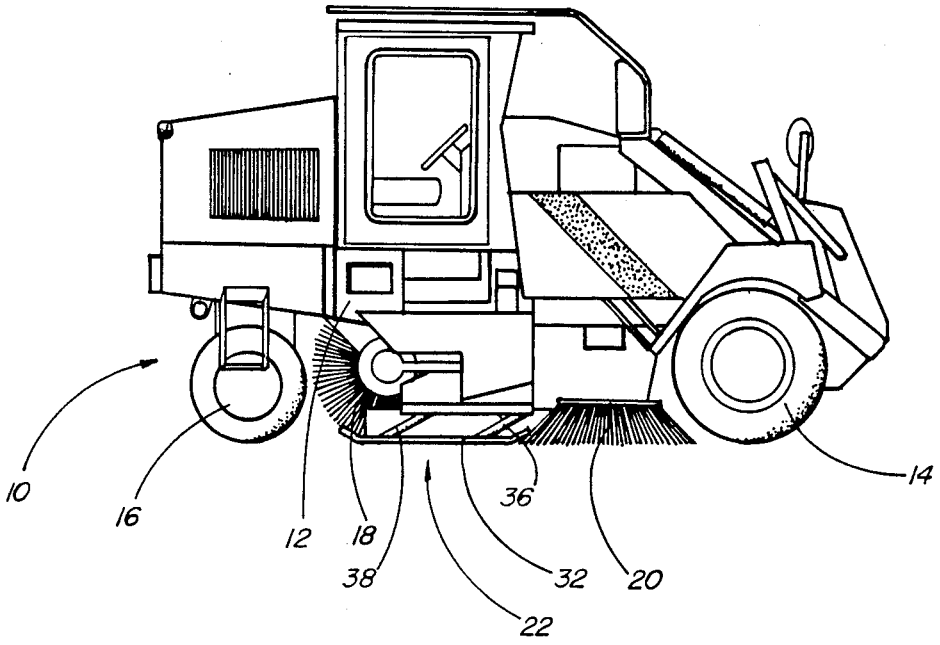
FIG. 1 is a side elevational view of a street sweeper having the drag shoe assembly of the present invention incorporated therein.

With further reference to the drawings, a street sweeper is shown therein and indicated generally by the numeral 10. Briefly reviewing street sweeper 10 it is seen that the same comprises a wheel supported frame structure 12 that is supported by a pair of front wheels 14 and a rear steerable wheel 16.

Rotatively mounted about a transverse axis underneath the street sweeper 10 is a rotatively driven brush or broom 18. Disposed forwardly of broom 18 about each side of sweeper 10 is a side leading brush 20 that is rotatively driven about a generally vertical axis. In operation, brushes 20 tend to sweep dirt, debris and dust inwardly underneath the sweeper 10 where the same is engaged by the transverse brush 18. It will be appreciated that transverse brush 18 rotates counter to the direction of travel, as indicated by the directional arrow in FIG. 2. In conventional fashion dirt, dust, debris, etc., engaged by the brush 18 is lifted and conveyed onto an incline conveyor system (not shown) where the dust, debris, dirt, etc., is transferred to a hopper that forms a part of the sweeper 10.

Details of sweeper 10 are not dealt with herein in detail because such is well known and appreciated in the prior art and because the sweeper structure itself is not per se material to the present invention. The sweeper shown and disclosed in this patent application is of the type produced by Athey Products of Wake Forest, N.C.

Secured to each side of sweeper 10 adjacent brush 18 is a drag shoe assembly indicated generally by the numeral 22. Drag shoe assembly 22 includes an upper frame member 24 that is secured directly to the side frame structure 12 of the sweeper 10. As shown in the drawings, upper frame member 24 includes a side plate 26 that is bolted to the frame structure 12 of the street sweeper 10 via a series of bolts 30. Extending along the lower portion of upper frame member 24 is a U-shaped channel 28.

Forming a part of the drag shoe assembly 22 is a drag shoe 32 that actually engages the surface being traverse by the street sweeper 10. Viewing drag shoe 32 it is seen that the same includes an elongated lower surface engaging portion and a longitudinally spaced outer bracket 32*a* and an inner wall 32*b*.

Figure 3:
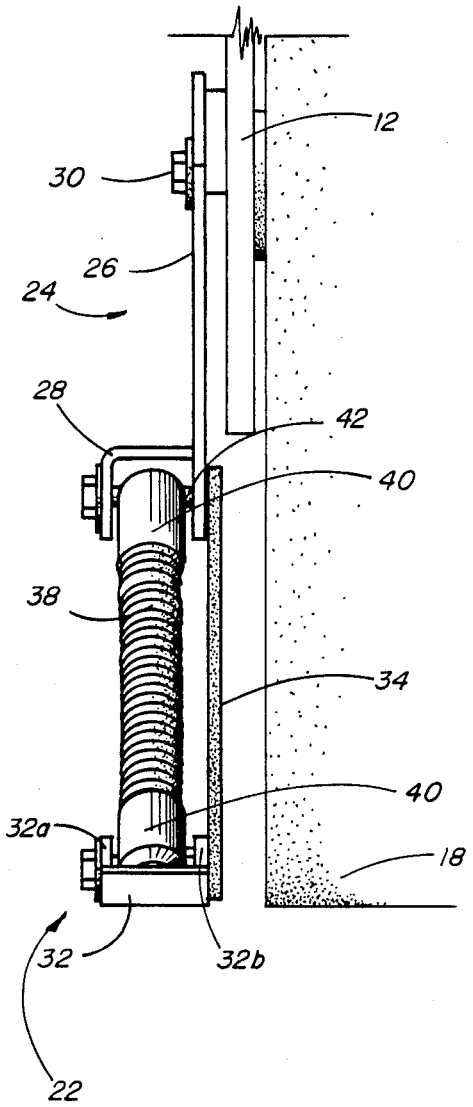
FIG. 3 is a rear elevational view of the drag shoe assembly shown in FIG. 2.

Secured to the inside of drag shoe 32 is a dirt shield or retaining panel 34 that extends upwardly therefrom. As viewed in FIGS. 3 and 4, the dirt shield or retaining panel 34 includes an upper free end that is disposed inwardly of the upper frame member 24. The dirt shield 34 is somewhat flexible but yet is sufficiently rigid such that it will extend upwardly and retain the posture shown in FIG. 3 when the drag shoe assumes its normal vertical position, which is illustrated in FIG. 3. In the present case, the dirt shield or retaining panel 34 is preferably constructed from a relatively hard but flexible rubber material.

Interconnected between the upper frame member 24 and the drag shoe 32 is a pair of coil spring 36 and 38. Each coil spring includes a rigid end section 40 that includes a transverse opening formed therethrough. A series of pivot pins 42 extend through the openings within the rigid end sections 40 and connect coil springs 36 and 38 to both the upper frame member 24 and the drag shoe 32.

It is thusly appreciated that each coil spring 36 and 38 is pivotally connected about opposite ends. This allows the drag shoe 32 to flow up and down as the street sweeper 10 traverses uneven or undulating surfaces.

In addition, the provision of the coil springs 36 and 38 enable the drag shoe 32 to withstand substantial lateral impacts from obstructions such as manhole covers, curbs, or the like.

Figure 2:
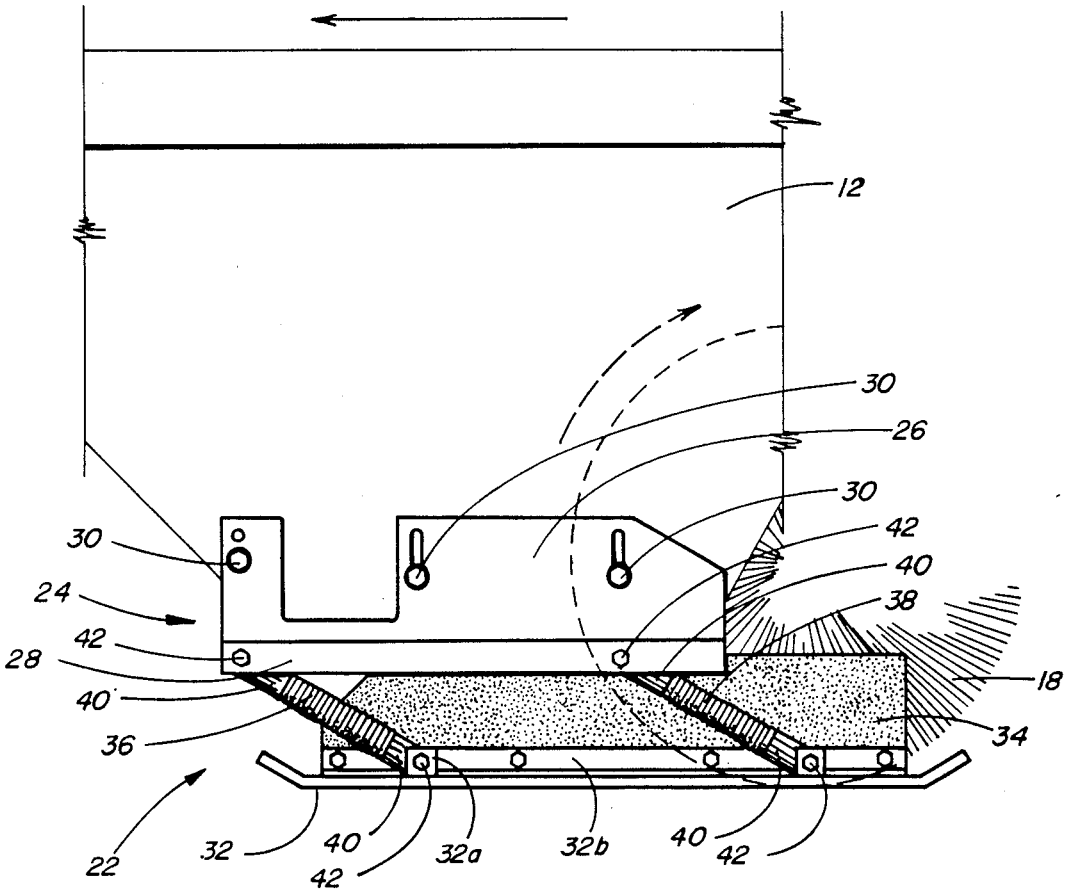
FIG. 2 is an enlarged side elevational view of the drag shoe assembly of the present invention shown secured to a street sweeper.
Figure 4:
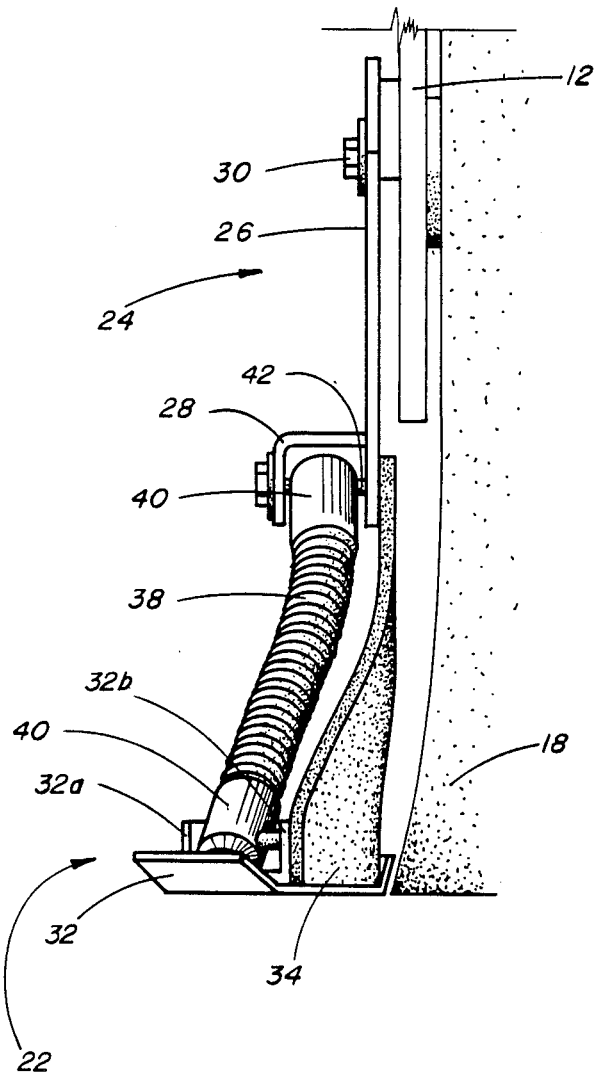
FIG. 4 is a rear elevational view of the drag shoe showing the flexing of the interconnecting coil spring.

In FIG. 4 there is illustrated the flexing of the coil springs so as to permit the drag shoe 32 to move laterally from its normal vertical position shown in FIGS. 2 and 3. The illustration depicted in FIG. 4 represents a situation where the inside of the drag shoe 32 engages an obstruction while the street sweeper 10 is tending to turn or laterally move into the obstruction. Once the obstruction has been cleared, it is appreciated that the strength of the springs 36 and 38 will cause the drag shoe to move back to its initial and normal vertical position.

It is appreciated that the size and strength of the coil springs could vary depending upon application.

It is appreciated from the foregoing specification and discussion that in the case of the drag shoe impacting against an obstruction or other lateral load while the sweeper is turning or otherwise moving laterally, results in the coil springs 36 and 38 absorbing the shock and consequently avoids damage to the drag shoe 32, the upper frame member 24 and the frame structure 12 of the street sweeper.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. In a street sweeper having a drag shoe assembly disposed outwardly of and adjacent to each side of a rotating brush for generally confining dirt debris, etc., inwardly of the drag shoe assembly as the brush is rotated and wherein each drag shoe assembly includes an upper frame member secured to the street sweeper and a drag shoe moveably mounted to the upper frame member, the improvement comprising a linkage arrangement for interconnecting the drag shoe with the upper frame member such that the drag shoe may (1) move vertically up and down with respect to the upper frame member as the street sweeper moves over uneven surfaces and (2) move laterally back and forth in response to the drag shoe engaging obstructions when the street sweeper is turning or otherwise moving laterally, the improved drag shoe linkage comprising a pair of coil springs interconnected between the upper frame member and the drag shoe; the coil springs being disposed in parallel relationship and having opposite ends pivotally mounted to the upper frame member and drag shoe; and wherein the coil springs may flex laterally back and forth in response to the drag shoe engaging a lateral obstruction and wherein the coil springs act to return the drag shoe to a normal vertical orientation once the drag shoe has cleared the lateral obstruction.

2. The improved street sweeper of claim 1 wherein each coil spring includes opposite rigid end caps and wherein each end cap is connected to the upper frame member or drag shoe through a pivot pin.

3. The improved street sweeper of claim 1 wherein the coil springs, upper frame member, and drag shoe, form a parallel, four-bar linkage.

4. A street sweeper with a laterally yieldable drag shoe assembly comprising:

(a) a street sweeper having a main frame and a surface engaging brush for engaging dirt and debris during a street sweeping operation;

(b) a drag shoe assembly mounted to each side of the street sweeper outwardly of and generally adjacent to the brush;

(c) each drag shoe assembly including a surface engaging drag shoe and a retaining panel extending upwardly from the drag shoe and disposed adjacent to and outwardly of a portion of the brush;

(d) coil spring linkage means connected between the street sweeper and the drag shoe for connecting the drag shoe to the sweeper and for laterally flexing in response to an obstruction or lateral load being applied against the drag shoe so as to enable the drag shoe to move laterally with respect to the street sweeper in response to the obstruction or lateral load so as to avoid damage to the drag shoe and the street sweeper, and to return to its initial normal horizontal position after the drag shoe has cleared the obstruction or lateral load; and (e) the coil spring linkage means including at least one coil spring linking the drag shoe to the street sweeper.

5. The street sweeper of claim 4 wherein the coil spring linkage means includes a pair of coil springs pivotally connected about opposite ends between the street sweeper and drag shoe so as to enable the drag shoe to float up and down over uneven surfaces as well as to flex laterally in response to obstructions or lateral loads being applied adjacent the drag shoe.

6. The street sweeper of claim 5 wherein the pair of coil springs are disposed in parallel relationship and wherein the coil springs, the drag shoe, and street sweeper form a parallel four-bar linkage.

7. The street sweeper of claim 6 including means for pivotally mounting opposite ends of each coil spring between the street sweeper and the drag shoe.

8. A street sweeper having a laterally yieldable drag shoe assembly comprising:

(a) a street sweeper having a main frame and a surface engaging sweeping brush;

(b) a drag shoe assembly mounted to each side of the street sweeper outwardly of the brush;

(c) each drag shoe assembly including an upper frame structure secured to the frame structure of the street sweeper, a surface engaging drag shoe, and a retaining panel secured to the drag shoe and extending upwardly therefrom and disposed adjacent to and outwardly of a portion of the brush; and (d) a pair of coil springs pivotally connected between the upper frame structure and the drag shoe, the pair of coil springs being disposed in general parallel relationship and interconnected such that the drag shoe can float up and down with respect to the street sweeper and wherein the coil springs can readily flex laterally back and forth in response to the drag shoe engaging a lateral obstruction so as to enable the entire drag shoe to move back and forth laterally to avoid damage to the drag shoe or the frame structure of the street sweeper.

* * * * *